US006881053B2

(12) United States Patent
Stephens et al.

(10) Patent No.: US 6,881,053 B2
(45) Date of Patent: Apr. 19, 2005

(54) BURNER WITH HIGH CAPACITY VENTURI

(75) Inventors: George Stephens, Humble, TX (US); David B. Spicer, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 0 days.

(21) Appl. No.: 10/388,910

(22) Filed: Mar. 14, 2003

(65) Prior Publication Data

US 2003/0175636 A1 Sep. 18, 2003

Related U.S. Application Data

(60) Provisional application No. 60/365,218, filed on Mar. 16, 2002.

(51) Int. Cl.[7] ..... F23M 3/00

(52) U.S. Cl. ..... 431/9; 431/5; 431/115; 126/91 A

(58) Field of Search ..... 431/9, 5, 115, 431/215; 126/91 A

(56) References Cited

U.S. PATENT DOCUMENTS

| | | | |
|---|---|---|---|
| 2,368,370 | A | 1/1945 | Maxon |
| 2,813,578 | A | 11/1957 | Ferguson |
| 2,918,117 | A | 12/1959 | Griffin |
| 2,983,312 | A | 5/1961 | Finley et al. |
| 3,880,570 | A | 4/1975 | Marshall |
| 4,004,875 | A | 1/1977 | Zink et al. |
| 4,089,629 | A | 5/1978 | Baumgartner et al. |
| 4,130,388 | A | 12/1978 | Flanagan |
| 4,230,445 | A | 10/1980 | Janssen |
| 4,257,763 | A | 3/1981 | Reed |
| 4,575,332 | A | 3/1986 | Oppenberg et al. |
| 4,629,413 | A | 12/1986 | Michelson et al. |
| 4,708,638 | A | 11/1987 | Brazier et al. |
| 4,739,713 | A | 4/1988 | Vier et al. |
| 4,748,919 | A | 6/1988 | Campobenedetto et al. |
| 4,815,966 | A | 3/1989 | Janssen |
| 4,828,483 | A | 5/1989 | Finke |
| 4,963,089 | A | 10/1990 | Spielman |
| 4,995,807 | A | 2/1991 | Rampley et al. |
| 5,044,931 | A | 9/1991 | Van Eerden et al. |
| 5,073,105 | A | 12/1991 | Martin et al. |
| 5,092,761 | A | 3/1992 | Dinocolantonio |
| 5,098,282 | A | 3/1992 | Schwartz et al. |
| 5,135,387 | A | 8/1992 | Martin et al. |
| 5,152,463 | A | 10/1992 | Mao et al. |
| 5,154,596 | A | 10/1992 | Schwartz et al. |
| 5,195,884 | A | 3/1993 | Schwartz et al. |

(Continued)

FOREIGN PATENT DOCUMENTS

| | | |
|---|---|---|
| DE | 2944153 | 5/1981 |
| DE | 3232421 | 3/1984 |
| DE | 3818265 | 11/1989 |

(Continued)

OTHER PUBLICATIONS

Straitz III, John F., et al., "Combat NOx With Better Burner Design," *Chemical Engineering*, Nov. 1994, pp. EE–4–EE–8.

(Continued)

*Primary Examiner*—Alfred Basichas

(57) ABSTRACT

An improved burner and a method for combusting fuel in burners used in furnaces, such as those used in steam cracking, are disclosed. The burner includes a burner tube having an upstream end, a downstream end and a venturi intermediate said upstream and downstream ends, the venturi including a throat portion having substantially constant internal cross-sectional dimensions such that the ratio of the length to maximum internal cross-sectional dimension of the throat portion is at least 3. A burner tip is mounted on the downstream end of the burner tube adjacent a first opening in the furnace, so that combustion of the fuel gas takes place downstream of said burner tip.

16 Claims, 10 Drawing Sheets

U.S. PATENT DOCUMENTS

| | | | | |
|---|---|---|---|---|
| 5,201,650 | A | | 4/1993 | Johnson |
| 5,224,851 | A | | 7/1993 | Johnson |
| 5,238,395 | A | | 8/1993 | Schwartz et al. |
| 5,254,325 | A | * | 10/1993 | Yamasaki et al. ..... 423/450 |
| 5,263,849 | A | | 11/1993 | Irwin et al. |
| 5,269,679 | A | | 12/1993 | Syska et al. |
| 5,275,554 | A | | 1/1994 | Faulkner |
| 5,284,438 | A | | 2/1994 | McGill et al. |
| 5,299,930 | A | | 4/1994 | Weidman |
| 5,316,469 | A | | 5/1994 | Martin et al. |
| 5,326,254 | A | | 7/1994 | Munk |
| 5,344,307 | A | | 9/1994 | Schwartz et al. |
| 5,350,293 | A | | 9/1994 | Khinkis et al. |
| 5,370,526 | A | | 12/1994 | Buschulte et al. |
| 5,407,345 | A | | 4/1995 | Robertson et al. |
| 5,413,477 | A | | 5/1995 | Moreland |
| 5,470,224 | A | | 11/1995 | Bortz |
| 5,472,341 | A | | 12/1995 | Meeks |
| 5,542,839 | A | | 8/1996 | Kelly |
| 5,562,438 | A | | 10/1996 | Gordon et al. |
| 5,584,684 | A | | 12/1996 | Dobbeling et al. |
| 5,603,906 | A | | 2/1997 | Lang et al. |
| 5,611,682 | A | | 3/1997 | Slavejkov et al. |
| 5,624,253 | A | | 4/1997 | Sulzhik et al. |
| 5,685,707 | A | | 11/1997 | Ramsdell et al. |
| 5,688,115 | A | * | 11/1997 | Johnson ..... 431/9 |
| 5,807,094 | A | | 9/1998 | Sarv |
| 5,813,846 | A | * | 9/1998 | Newby et al. ..... 431/9 |
| 5,980,243 | A | | 11/1999 | Surbey et al. |
| 5,984,665 | A | | 11/1999 | Loftus et al. |
| 5,987,875 | A | | 11/1999 | Hilburn et al. |
| 5,993,193 | A | | 11/1999 | Loftus et al. |
| 6,007,325 | A | | 12/1999 | Loftus et al. |
| 6,056,538 | A | | 5/2000 | Büchner et al. |
| 6,332,408 | B1 | | 12/2001 | Howlett et al. |
| 6,347,935 | B1 | | 2/2002 | Schindler et al. |
| 6,383,462 | B1 | | 5/2002 | Lang |
| 6,616,442 | B1 | | 9/2003 | Venizelos et al. |

FOREIGN PATENT DOCUMENTS

| | | |
|---|---|---|
| EP | 0099828 | 6/1988 |
| EP | 0 374 423 | 6/1990 |
| EP | 0 507 233 | 10/1992 |
| EP | 0 751 343 | 1/1997 |
| EP | 0486169 | 1/1998 |
| EP | 1096202 | 2/2001 |
| EP | 1 211 458 | 6/2002 |
| FR | 2629900 | 10/1988 |
| SU | 374488 | 5/1970 |

OTHER PUBLICATIONS

Vahdati, M. M., et al., "Design And Development of A Low NOx Coanda Ejector Burner," *Journal of the Institute of Energy*, Mar. 2000, vol. 73, pp. 12–17.

Bussman, Wes, et al., "Low NOx Burner Technology for Ethylene Cracking Furnaces," presented at the *2001 AIChE Spring National Meeting, 13th Annual Ethylene Producers Conference*, Houston, TX, Apr. 25, 2001, pp. 1–23.

Seebold, James G., "Reduce Heater NOx in the Burner," *Hydrocarbon Processing*, Nov. 1982, pp. 183–186.

"West Germany's Caloric Develops a Low–NOx Recycling Fuel Burner," *Chemical Engineering*, Oct. 4, 1982, p. 17.

Chemical Engineering Progress, vol. 43, 1947, "The Design of Jet Pumps" by A. Edgar Kroll, pp. 21–24, vol. 1, No. 2.

Abstract of EP 0 507 233 published on Oct. 7, 1992, entitled "Burner for Liquid Fuels".

* cited by examiner

BURNER WITH HIGH CAPACITY VENTURI

RELATED APPLICATIONS

This patent application claims priority from Provisional Application Ser. No. 60/365,218, filed on Mar. 16, 2002, the contents of which are hereby incorporated by reference.

FIELD OF THE INVENTION

This invention relates to an improved burner of the type employed in high temperature furnaces. More particularly, the invention relates to a burner having a high capacity venturi so as to allow increased flue gas recirculation and thereby reduce $NO_x$ emissions.

BACKGROUND OF THE INVENTION

As a result of the interest in recent years to reduce the emission of pollutants from burners of the type used in large furnaces and boilers, significant improvements have been made in burner design. In the past, burner design improvements were aimed primarily at improving heat distribution to provide more effective heat transfer. However, increasingly stringent environmental regulations have shifted the focus of burner design to the minimization of regulated pollutants.

Oxides of nitrogen ($NO_x$) are formed in air at high temperatures. These compounds include, but are not limited to, nitrogen oxide and nitrogen dioxide. Reduction of $NO_x$ emissions is a desired goal to decrease air pollution and meet government regulations.

The rate at which nitrogen oxide is formed is dependent upon the following variables: (1) flame temperature, (2) residence time of the combustion gases in the high temperature zone and (3) excess oxygen supply. The rate of formation of nitrogen oxide increases as flame temperature increases. However, the reaction takes time and a mixture of nitrogen and oxygen at a given temperature for a very short time may produce less nitric oxide than the same mixture at a lower temperature, over a longer period of time.

One strategy for achieving lower $NO_x$ emission levels is to install a $NO_x$ reduction catalyst to treat the furnace exhaust stream. This strategy, known as Selective Catalytic Reduction (SCR), is very costly and, although it can be effective in meeting more stringent regulations, it represents a less desirable alternative to improvements in burner design.

Burners used in large industrial furnaces may use either liquid or gaseous fuel. Liquid fuel burners mix the fuel with steam prior to combustion to atomize the fuel to enable more complete combustion, and mix combustion air with the fuel at the zone of combustion.

Gas fired burners can be classified as either premix or raw gas, depending on the method used to combine the air and fuel. They also differ in configuration and the type of burner tip used.

Raw gas burners inject fuel directly into the air stream, such that the mixing of fuel and air occurs simultaneously with combustion. Since airflow does not change appreciably with fuel flow, the air register settings of natural draft burners must be changed after firing rate changes. Therefore, frequent adjustment may be necessary, as explained in detail in U.S. Pat. No. 4,257,763. In addition, many raw gas burners produce luminous flames.

Premix burners mix some or all of the fuel with some or all of the combustion air prior to combustion. Since premixing is accomplished by using the energy present in the fuel stream, airflow is largely proportional to fuel flow. As a result, therefore, less frequent adjustment is required. Premixing the fuel and air also facilitates the achievement of the desired flame characteristics. Due to these properties, premix burners are often compatible with various steam cracking furnace configurations.

Floor-fired premix burners are used in many steam crackers and steam reformers primarily because of their ability to produce a relatively uniform heat distribution profile in the tall radiant sections of these furnaces. Flames are non-luminous, permitting tube metal temperatures to be readily monitored. Therefore, a premix burner is the burner of choice for such furnaces. Premix burners can also be designed for special heat distribution profiles or flame shapes required in other types of furnaces.

One technique for reducing $NO_x$ that has become widely accepted in industry is known as combustion staging. With combustion staging, the primary flame zone is deficient in either air (fuel-rich) or fuel (fuel-lean). The balance of the air or fuel is injected into the burner in a secondary flame zone or elsewhere in the combustion chamber. As is well known, a fuel-rich or fuel-lean combustion zone is less conducive to $NO_x$ formation than an air-fuel ratio closer to stoichiometry. Combustion staging results in reducing peak temperatures in the primary flame zone and has been found to alter combustion speed in a way that reduces $NO_x$. Since $NO_x$ formation is exponentially dependent on gas temperature, even small reductions in peak flame temperature can dramatically reduce $NO_x$ emissions. However this must be balanced with the fact that radiant heat transfer decreases with reduced flame temperature, while CO emissions, an indication of incomplete combustion, may actually increase.

In the context of premix burners, the term primary air refers to the air premixed with the fuel; secondary, and in some cases tertiary, air refers to the balance of the air required for proper combustion. In raw gas burners, primary air is the air that is more closely associated with the fuel; secondary and tertiary air are more remotely associated with the fuel. The upper limit of flammability refers to the mixture containing the maximum fuel concentration (fuel-rich) through which a flame can propagate.

U.S. Pat. No. 4,629,413 discloses a premix burner that employs combustion staging to reduce $NO_x$ emissions. The premix burner of U.S. Pat. No. 4,629,413 lowers $NO_x$ emissions by delaying the mixing of secondary air with the flame and allowing some cooled flue gas to recirculate with the secondary air. The entire contents of U.S. Pat. No. 4,629,413 are incorporated herein by reference.

U.S. Pat. No. 5,092,761 discloses a method and apparatus for reducing $NO_x$ emissions from premix burners by recirculating flue gas. Flue gas is drawn from the furnace through recycle ducts by the inspirating effect of fuel gas and combustion air passing through a venturi portion of a burner tube. Air flow into the primary air chamber is controlled by dampers and, if the dampers are partially closed, the reduction in pressure in the chamber allows flue gas to be drawn from the furnace through the recycle ducts and into the primary air chamber. The flue gas then mixes with combustion air in the primary air chamber prior to combustion to dilute the concentration of oxygen in the combustion air, which lowers flame temperature and thereby reduces $NO_x$ emissions. The flue gas recirculating system may be retrofitted into existing premix burners or may be incorporated in new low $NO_x$ burners. The entire contents of U.S. Pat. No. 5,092,761 are incorporated herein by reference.

Analysis of burners of the type disclosed in U.S. Pat. No. 5,092,761 has shown that the flue gas recirculation (FGR) ratio is generally in the range of 5 to 10%, where the FGR ratio is defined as:

$$\text{FGR ratio } (\%) = 100 \times \frac{(\text{lb. of flue gas drawn into venturi})}{(\text{lb. fuel combusted in burner} + \text{lb. air drawn into burner})}$$

The ability of existing burners of this type to generate higher FGR ratios is limited by the inspirating capacity of the fuel orifice/gas spud/venturi combination. Although further closing of the primary air dampers can further reduce the pressure in the primary air chamber and thereby enable increased FGR ratios, the resultant reduction of primary air flow is such that insufficient oxygen is present in the venturi for acceptable burner stability.

As disclosed in "The Design of Jet Pumps" by A. E. Knoll, appearing in Vol. 43 of Chemical Engineering Progress, published by the American Institute of Chemical Engineers (1947), it is known to optimize the operation of venturis used in air and steam operated air movers at relatively mild (roughly ambient) temperatures. In contrast, in the burner of the invention, combustible gaseous fuel (including, but not limited to, methane, $H_2$, ethane and propane) is used to move a combination of very hot (above 1000° F.) flue gases, hot air, hot uncombusted fuel (CO), and ambient air.

SUMMARY OF THE INVENTION

In one aspect, the present invention is directed to an improved burner for the combustion of fuel in a furnace, said burner comprising:

(a) a burner tube having an upstream end, a downstream end and a venturi intermediate said upstream and downstream ends, said venturi including a throat portion having substantially constant internal cross-sectional dimensions such that the ratio of the length to maximum internal cross-sectional dimension of said throat portion is at least 3; and (b) a burner tip mounted on the downstream end of said burner tube adjacent a first opening in the furnace, so that combustion of the fuel takes place downstream of said burner tip.

Preferably, the ratio of the length to maximum internal cross-sectional dimension of said throat portion is from about 4 to about 10, more preferably from about 4.5 to about 8, more preferably from about 6.5 to 7.5 and most preferably from about 6.5 to 7.0.

In a further aspect, the invention resides in a method for combusting fuel in a burner of a furnace, comprising the steps of combining fuel gas and air at a predetermined location; drawing the fuel gas and air so combined through a venturi, and combusting said fuel gas at a combustion zone downstream of said predetermined location and said venturi; wherein said venturi includes a throat portion having substantially constant internal cross-sectional dimensions such that the ratio of the length to maximum internal cross-sectional dimension of said throat portion is at least 3.

BRIEF DESCRIPTION OF THE DRAWINGS

The invention is further explained in the description that follows with reference to the drawings wherein.

DETAILED DESCRIPTION OF THE ILLUSTRATED EMBODIMENTS

Figure 1:
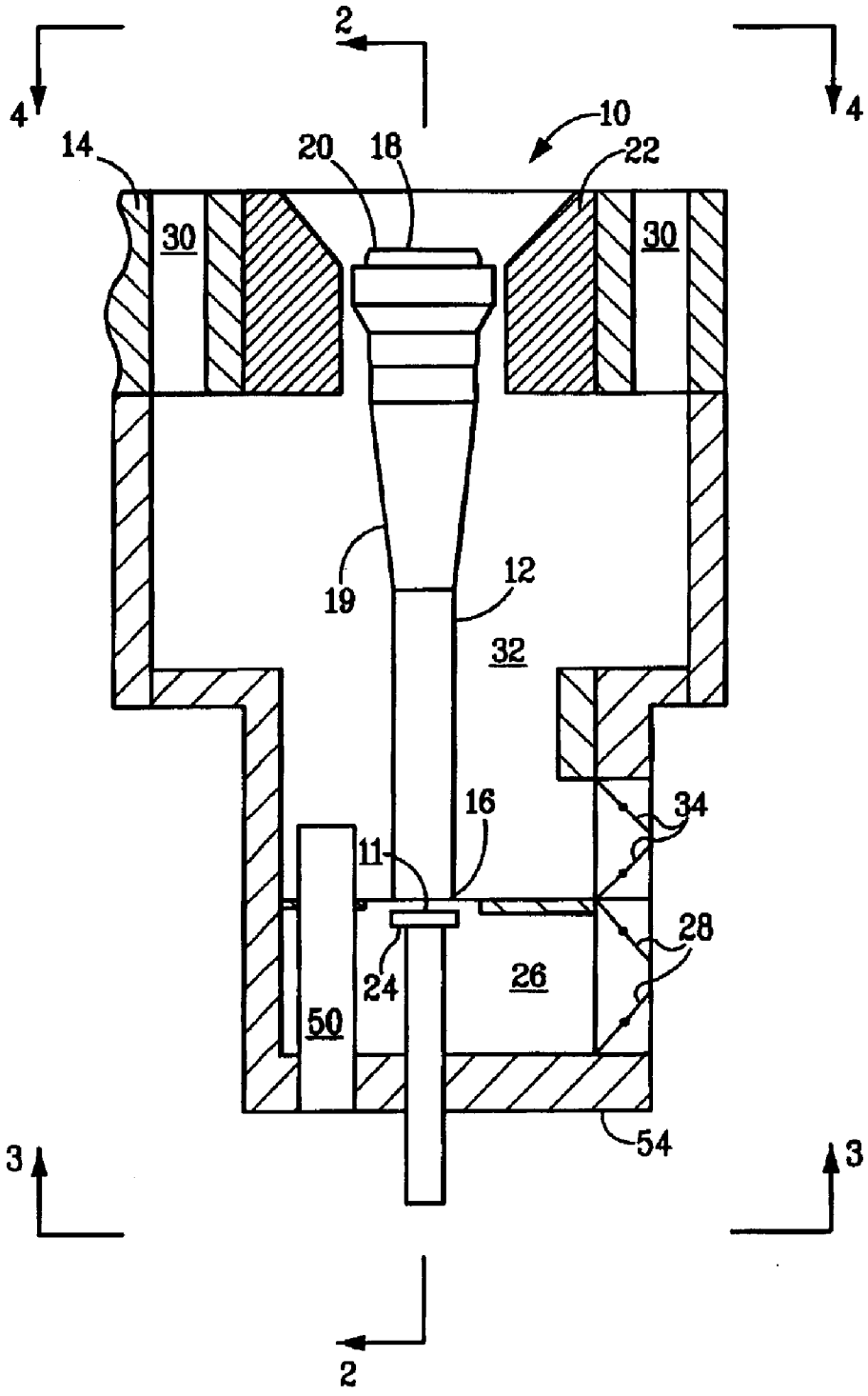
FIG. 1 illustrates an elevation partly in section of a premix burner in accordance with an embodiment of the present invention.

Although the present invention is described in terms of a burner for use in connection with a furnace or an industrial furnace, it will be apparent to one of skill in the art that the teachings of the present invention also have applicability to other process components such as, for example, boilers. Thus, the term furnace herein shall be understood to mean furnaces, boilers and other applicable process components.

Referring to FIG. 1 through FIG. 4, a burner 10 includes a freestanding burner tube 12 located in a well in a furnace floor 14. Burner tube 12 includes an upstream end 16, a downstream end 18 and a venturi 19. Burner tip 20 is located at downstream end 18 of tube 12 and is surrounded by an annular tile 22. A fuel orifice 11, which may be located within a gas spud 24, is located at upstream end 16 of tube 12 and introduces fuel gas into burner tube 12. Fresh or ambient air is introduced into primary air chamber 26 through adjustable damper 28 to mix with the fuel gas at upstream end 16 of burner tube 12. Combustion of the fuel gas and fresh air occurs downstream of the burner tip 20.

A plurality of air ports 30 originate in secondary air chamber 32 and pass through furnace floor 14 into the furnace. Fresh air enters secondary air chamber 32 through adjustable dampers 34 and passes through staged air ports 30 into the furnace to provide secondary or staged combustion.

In order to recirculate flue gas from the furnace to the primary air chamber, ducts or pipes 36, 38 extend from openings 40, 42, respectively, in the floor of the furnace to openings 44, 46, respectively, in burner plenum 48. Flue gas is drawn through pipes 36, 38 by the inspirating effect of fuel gas passing through venturi 19 of burner tube 12. In this manner, the primary air and flue gas are mixed in primary air chamber 26, which is prior to the zone of combustion. The amount of inert material mixed with the fuel is raised, thereby reducing the flame temperature, and as a result, reducing $NO_x$ emissions. Closing or partial closing damper 28 restricts the amount of fresh air that can be drawn into the primary air chamber 26 and thereby provides the vacuum necessary to draw flue gas from the furnace floor.

Unmixed low temperature ambient air, having entered secondary air chamber 32 through dampers 34 and having passed through air ports 30 into the furnace, is also drawn through pipes 36, 38 into the primary air chamber by the inspirating effect of the fuel gas passing through venturi 19. The ambient air may be fresh air as discussed above. The mixing of the ambient air with the flue gas lowers the temperature of the hot flue gas flowing through pipes 36, 38 and thereby substantially increases the life of the pipes and permits use of this type of burner to reduce $NO_x$ emissions in high temperature cracking furnaces having flue gas temperature above 1900° F. in the radiant section of the furnace.

It is preferred that a mixture of from about 20% to about 80% flue gas and from about 20% to about 80% ambient air should be drawn through pipes 36, 38. It is particularly preferred that a mixture of about 50% flue gas and about 50% ambient air be employed. The desired proportions of flue gas and ambient air may be achieved by proper sizing, placement and/or design of pipes 36, 38 in relation to air ports 30, as those skilled in the art will readily recognize. That is, the geometry of the air ports, including but not limited to their distance from the burner tube, the number of air ports, and the size of the air ports, may be varied to obtain the desired percentages of flue gas and ambient air.

A sight and lighting port 50 is provided in the primary air chamber 26, extending into secondary air chamber 32, both to allow inspection of the interior of the burner assembly, and to provide access for lighting of the burner.

Figure 2:
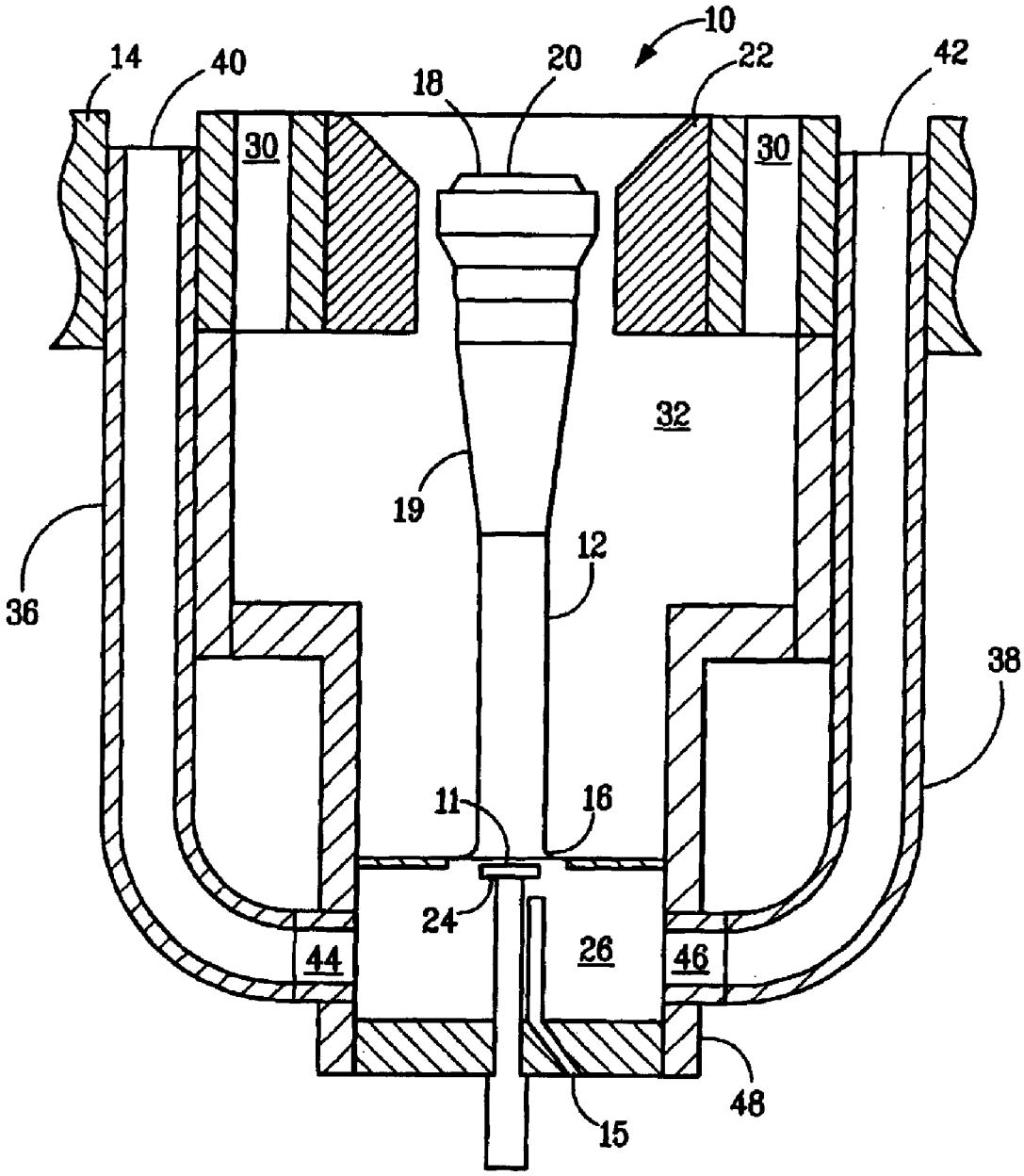
FIG. 2 is an elevation partly in section taken along line 2—2 of FIG. 1.
Figure 3:
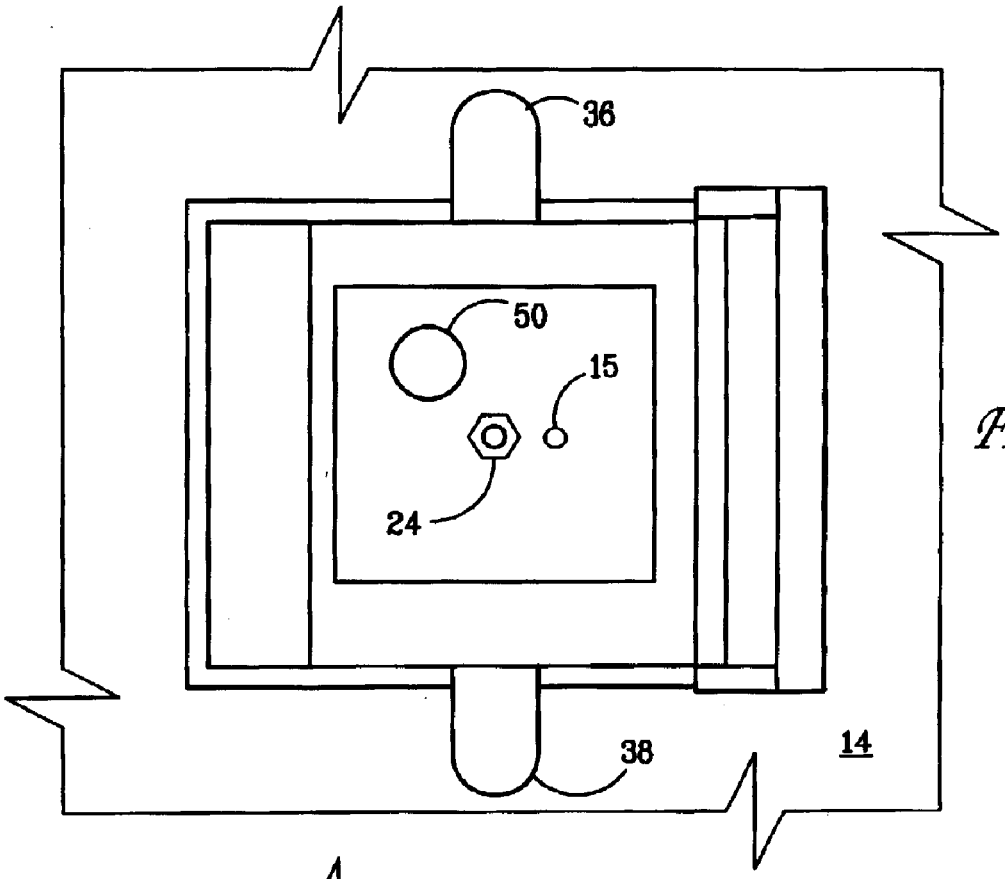
FIG. 3 is a plan view taken along line 3—3 of FIG. 1.
Figure 4:
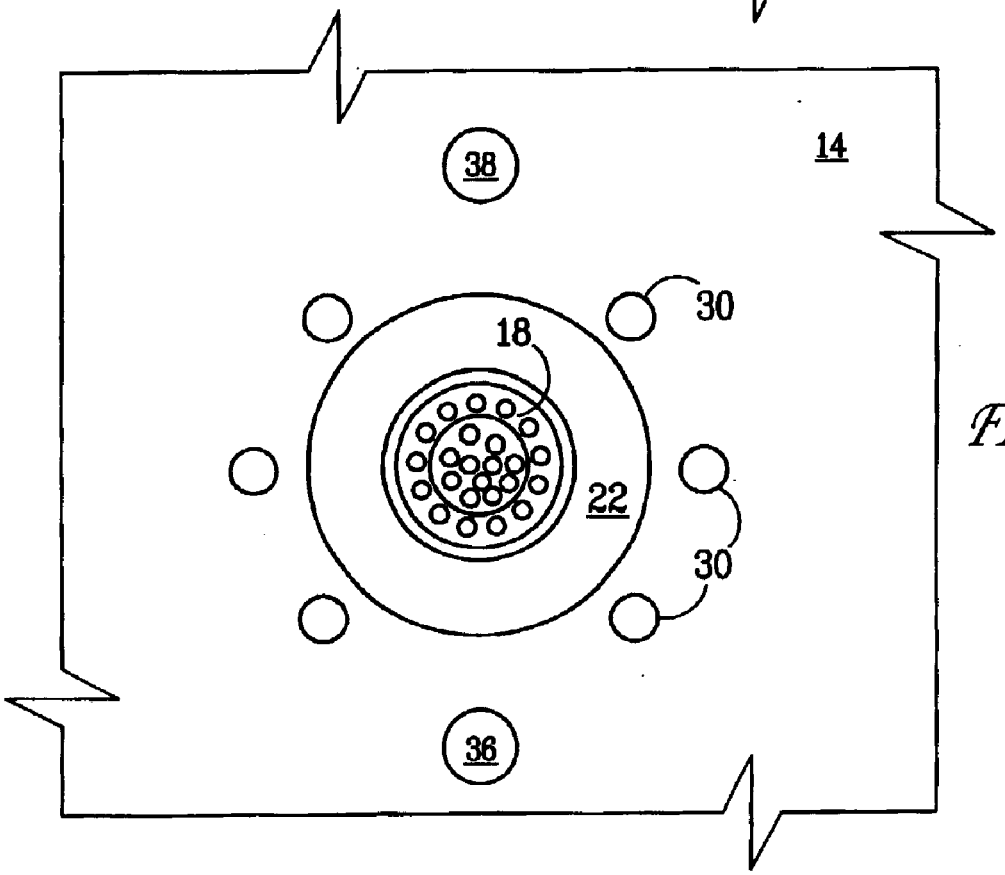
FIG. 4 is a plan view taken along line 4—4 of FIG. 1.

As is shown in FIGS. 1, 2 and 4, a small gap exists between the burner tip 20 and the burner tile 22. By keeping this gap small, the bulk of the secondary staged air is forced to enter the furnace through staged air ports 30 located some distance from the primary combustion zone, which is located immediately on the furnace side of the burner tip 20. It has been discovered through testing that increasing the gap between the burner tip 20 and the burner tile 22 raises overall $NO_x$ but also raises overall flame stability. The size of the annular gap should be sized such that it is small enough to minimize $NO_x$, and large enough to maintain adequate flame stability.

Figure 5A:
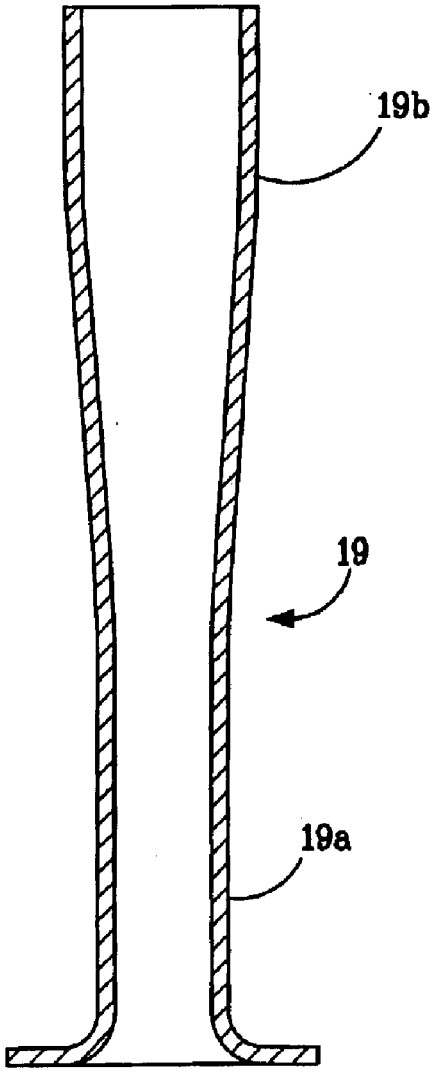
FIG. 5A and FIG. 5B are sectional views comparing, respectively the venturi of a conventional burner tube with the venturi of a burner tube of a burner in accordance with the present invention.
Figure 5B:
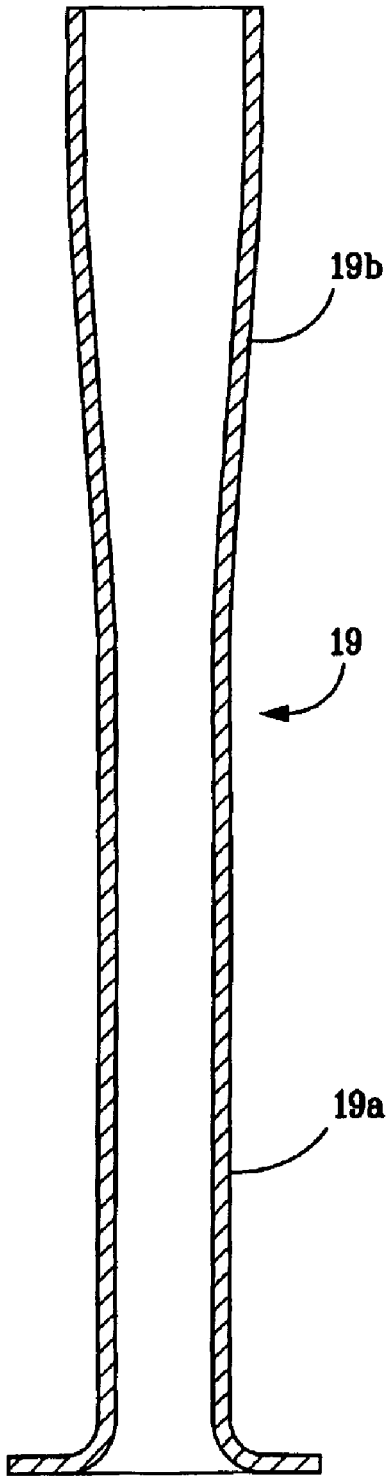

Referring now to FIG. 5A, a venturi 19 of a conventional burner, of the type disclosed in U.S. Pat. No. 5,092,761, includes a relatively short throat portion 19*a* that is of substantially constant internal cross-sectional dimensions along its length and a divergent cone portion 19*b*, wherein the ratio of the length to maximum internal cross-sectional dimension of the throat portion 19*a* is less than 3, typically 2.6. As shown in FIG. 5B, a venturi of a burner tube of a burner in accordance with the present invention also includes a throat portion 19*a* of substantially constant internal cross-sectional dimensions and a divergent cone portion 19*b*. However, the throat portion 19*a* of the burner of the present invention is significantly longer than that of the conventional burner, as shown in FIG. 5A such that the ratio of the length to maximum internal cross-sectional dimension of the throat portion 19*a* is at least 3, preferably from about 4 to about 10, more preferably from about 4.5 to about 8, still more preferably from about 6.5 to about 7.5 and most preferably from about 6.5 to about 7.0. The internal surface of the throat portion 19*a* of the burner of the present invention is preferably cylindrical.

Increasing the ratio of length to internal cross-sectional dimensions in the throat portion of the venturi is found to reduce the degree of flow separation that occurs in the throat and cone portions of the venturi which increases the capacity of the venturi to entrain flue gas thereby allowing higher flue gas recirculation rates and hence reduced flame temperature and $NO_x$ production. A longer venturi throat also promotes better flow development and hence improved mixing of the fuel gas/air stream prior to the mixture exiting the burner tip 20. Better mixing of the fuel gas/air stream also contributes to $NO_x$ reduction by producing a more evenly developed flame and hence reducing peak temperature regions.

In addition to the use of flue gas as a diluent, another technique to achieve lower flame temperature through dilution is the use of steam injection. Steam can be injected in the primary air chamber 26 or the secondary air chamber 32. Preferably, steam is injected through steam injection tube 15, upstream of the venturi, for mixing with the primary air and recirculated flue gas to further reduce flame temperature and hence $NO_x$ emissions. The steam is conveniently provided through tube(s) terminating adjacent the gas spud 24, as shown.

Figure 6:
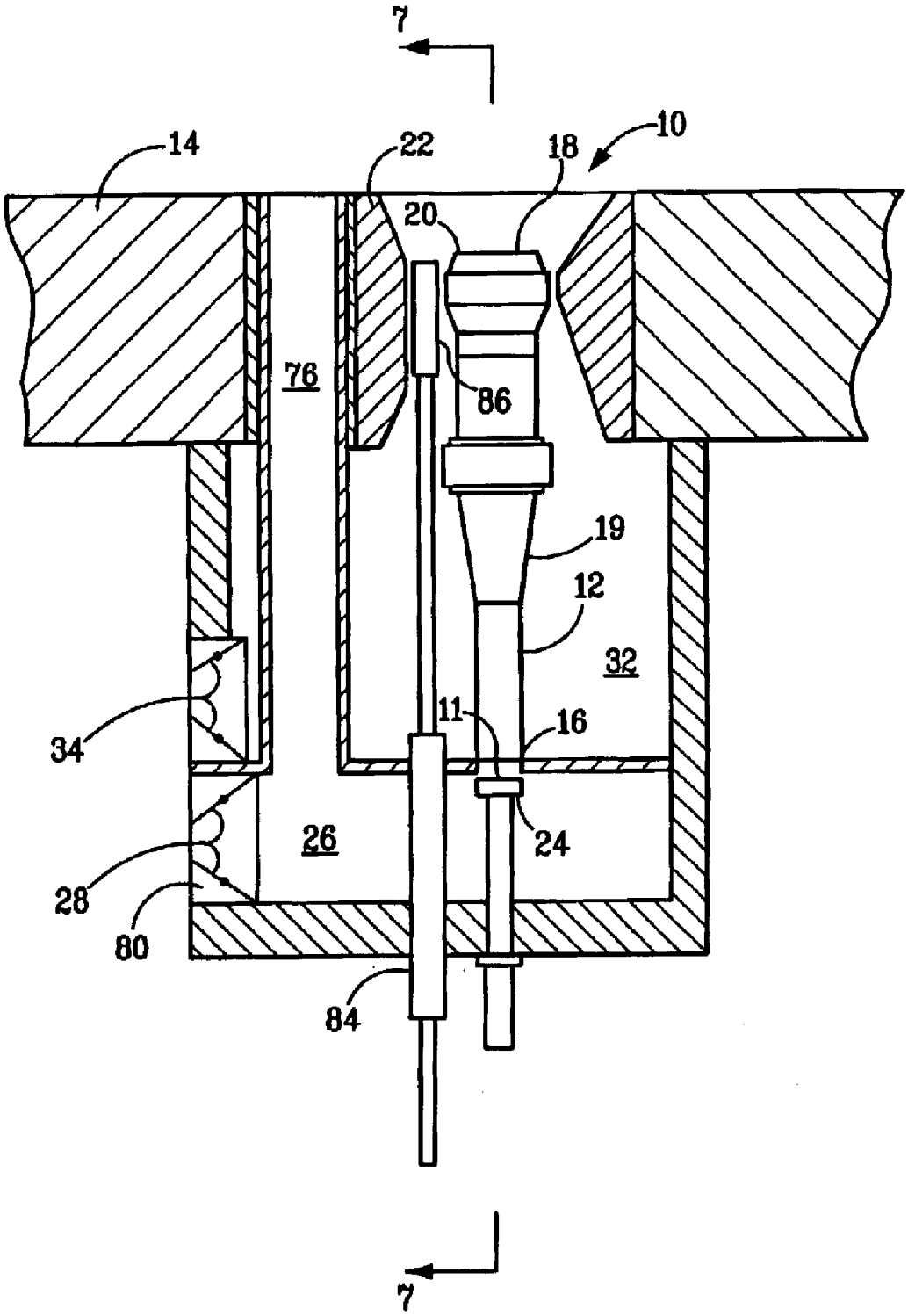
FIG. 6 is an elevation partly in section of a burner in accordance with another embodiment of the present invention.
Figure 7:
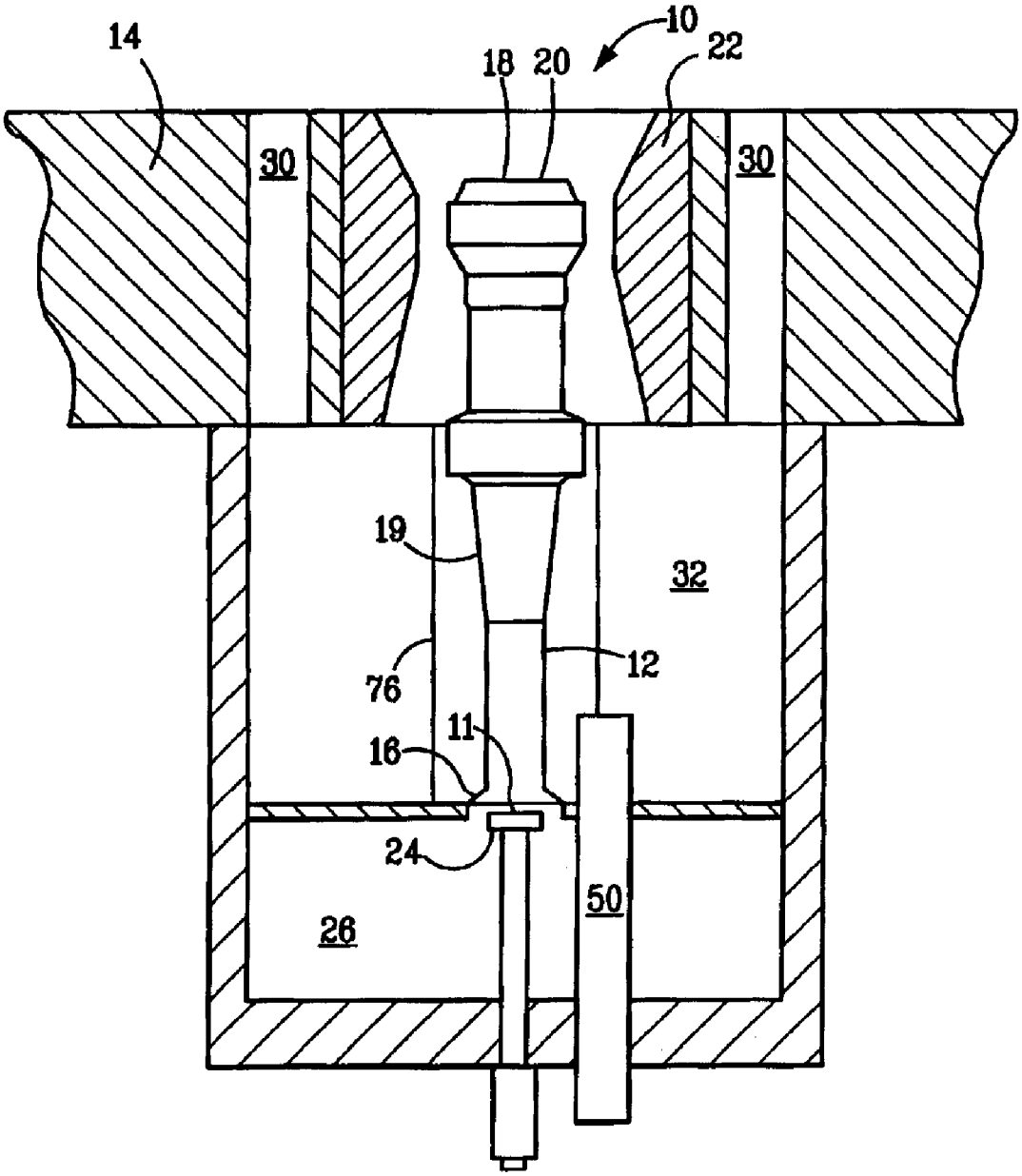
FIG. 7 is an elevation partly in section taken along line 7—7 of FIG. 6.

The increased capacity venturi shown in FIG. 5*b* may also be used in a low $NO_x$ burner design of the type illustrated in FIG. 6 and FIG. 7, wherein like reference numbers indicate like parts. As with the embodiment of FIGS. 1–4, in the embodiment shown in FIGS. 6 and 7, a burner 10 includes a freestanding burner tube 12 located in a well in a furnace floor 14. Burner tube 12 includes an upstream end 16, a downstream end 18 and a venturi portion 19. Burner tip 20 is located at downstream end 18 and is surrounded by an annular tile 22. A fuel orifice 11, which may be located within a gas spud 24, is located at upstream end 16 and introduces fuel gas into burner tube 12. Fresh or ambient air is introduced into primary air chamber 26 through adjustable damper 28 to mix with the fuel gas at upstream end 16 of burner tube 12. Combustion of the fuel gas and fresh air occurs downstream of burner tip 20.

A plurality of air ports 30 originate in secondary air chamber 32 and pass through furnace floor 14 into the furnace. Fresh air enters secondary air chamber 32 through adjustable dampers 34 and passes through the air ports 30 into the furnace to provide secondary or staged combustion. In order to recirculate flue gas from the furnace to the primary air chamber, a flue gas recirculation passageway 76 is formed in furnace floor 14 and extends to primary air chamber 26, so that flue gas is mixed with fresh air drawn into the primary air chamber from opening 80. Flue gas containing, for example, about 6–10% $O_2$ is drawn through passageway 76 by the inspirating effect of fuel gas passing through venturi portion 19 of burner tube 12. As with the embodiment of FIGS. 1–4, the primary air and flue gas are mixed in primary air chamber 26, which is prior to the zone of combustion. Closing or partially closing damper 28 restricts the amount of fresh air that can be drawn into the primary air chamber 26 and thereby provides the vacuum necessary to draw flue gas from the furnace floor.

Referring now to FIG. 7, sight and lighting port 50 provides access to the interior of secondary air chamber 32 for lighting element (not shown). Referring to FIG. 6, a tube 84 provides access to the interior of secondary air chamber 32 for an optional pilot 86. Light-off of the burner of the embodiment depicted in FIGS. 1–4 can be achieved in a similar manner.

Figure 9:
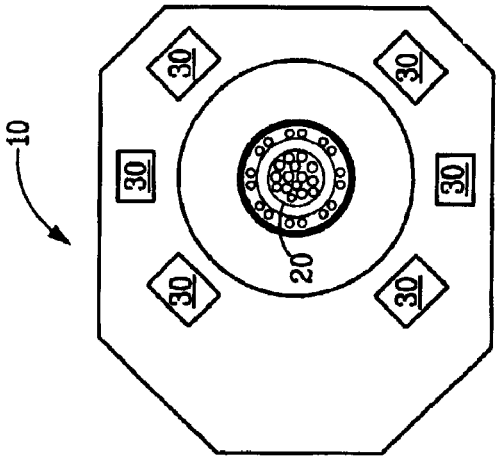
FIG. 9 is a plan view taken along line 9—9 of FIG. 8.
Figure 8:
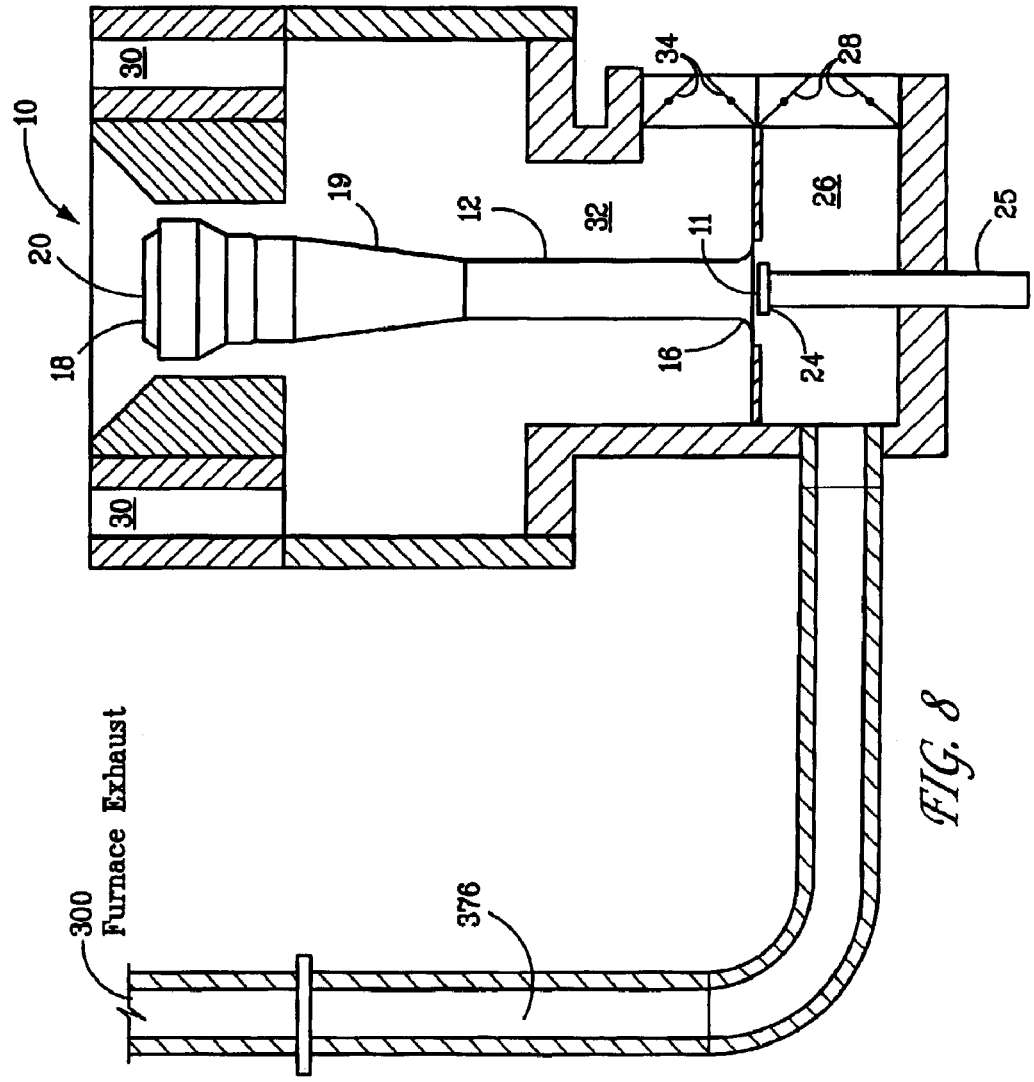
FIG. 8 is an elevation partly in section of a further embodiment of the present invention illustrating a burner with an external passageway.

Referring now to FIGS. 8 and 9, another embodiment of the present invention is shown. In this embodiment, the teachings above with respect to the venturi designs of the present invention may be applied in connection with a furnace having one or more burners utilizing an external FGR duct 376 in fluid communication with a furnace exhaust 300. It will be understood by one of skill in the art that several burners 10 (or 110, see FIGS. 10–11) will be located within the furnace, all of which feed furnace exhaust 300 and external FGR duct 376. The benefit with respect to improved inspiration produced by the venturi designs of the present invention serve to increase the motive force available to draw flue gas through FGR duct 376, eliminating or minimizing the need for an external fan to supply adequate levels of FGR.

The high capacity venturi disclosed herein can also be applied in flat-flame burners, as will now be described by reference to FIGS. 10 and 11.

Figure 10:
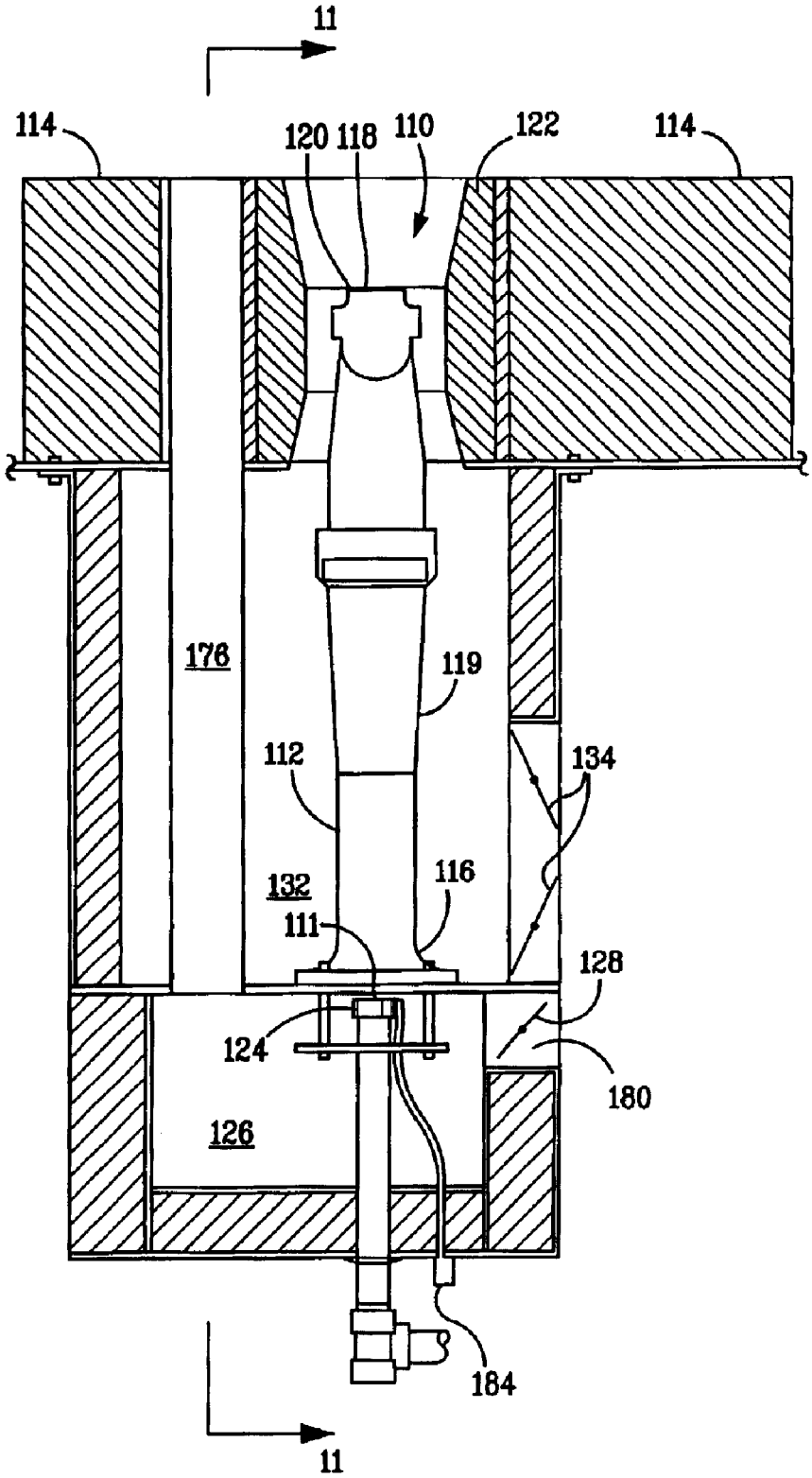
FIG. 10 is an elevation partly in section of a flat-flame burner in accordance with yet a further embodiment of the present invention.
Figure 11:
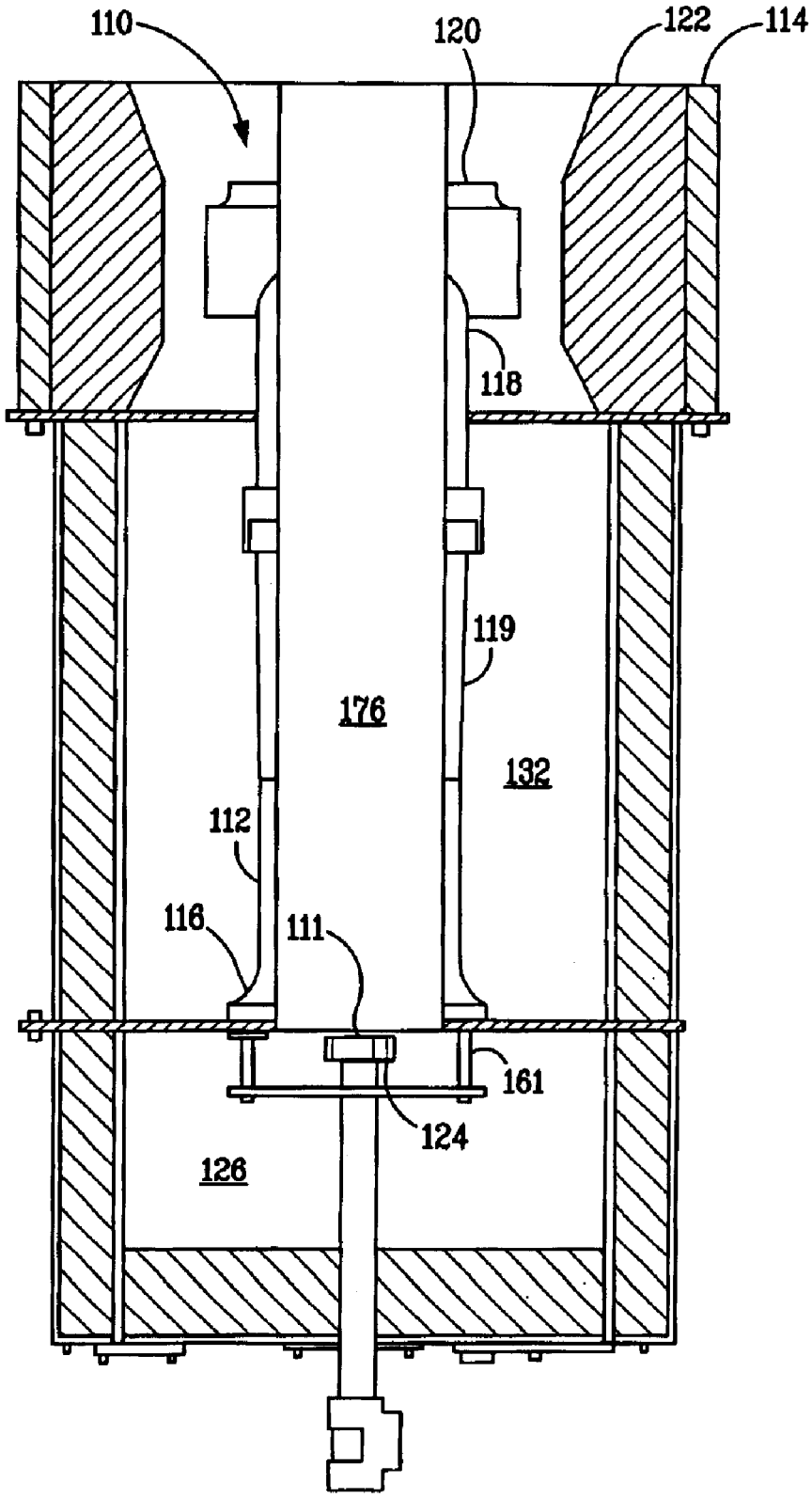
FIG. 11 is an elevation partly in section taken along line 11—11 of FIG. 10.

In the embodiment shown in FIGS. 10 and 11, a premix burner 110 includes a freestanding burner tube 112 located in a well in a furnace floor 114. Burner tube 112 includes an upstream end 116, a downstream end 118 and a venturi portion 119. Burner tip 120 is located at downstream end 118 and is surrounded by a peripheral tile 122. A fuel orifice 111, which may be located within gas spud 124, is located at upstream end 116 and introduces fuel gas into burner tube 112. Fresh or ambient air may be introduced into primary air chamber 126 to mix with the fuel gas at upstream end 116 of burner tube 112. Combustion of the fuel gas and fresh air occurs downstream of burner tip 120. Fresh secondary air enters secondary chamber 132 through dampers 134.

In order to recirculate flue gas from the furnace to the primary air chamber, a flue gas recirculation passageway 176 is formed in furnace floor 114 and extends to primary air chamber 126, so that flue gas is mixed with fresh air drawn into the primary air chamber from opening 180 through dampers 128. Flue gas containing, for example, 0 to about 15% $O_2$ is drawn through passageway 176 by the inspirating effect of fuel gas passing through venturi portion 119 of burner tube 112. Primary air and flue gas are mixed in primary air chamber 126, which is prior to the zone of combustion.

In operation, a fuel orifice 111, which may be located within gas spud 124, discharges fuel into burner tube 112, where it mixes with primary air, recirculated flue-gas or mixtures thereof. The mixture of fuel gas, recirculated flue-gas, and primary air then discharges from burner tip 120. The mixture in the venturi portion 119 of burner tube 112 is maintained below the fuel-rich flammability limit; i.e. there is insufficient air in the venturi to support combustion. Secondary air is added to provide the remainder of the air required for combustion.

Figure 12A:
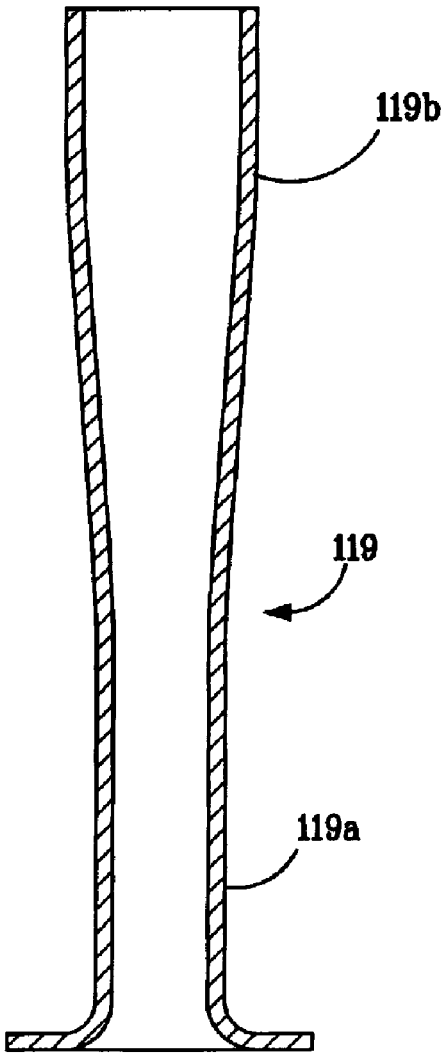
FIG. 12A and FIG. 12B are sectional views comparing, respectively the venturi of a conventional flat-flame burner tube with the venturi of a burner tube of a flat-flame burner in accordance with the present invention.
Figure 12B:
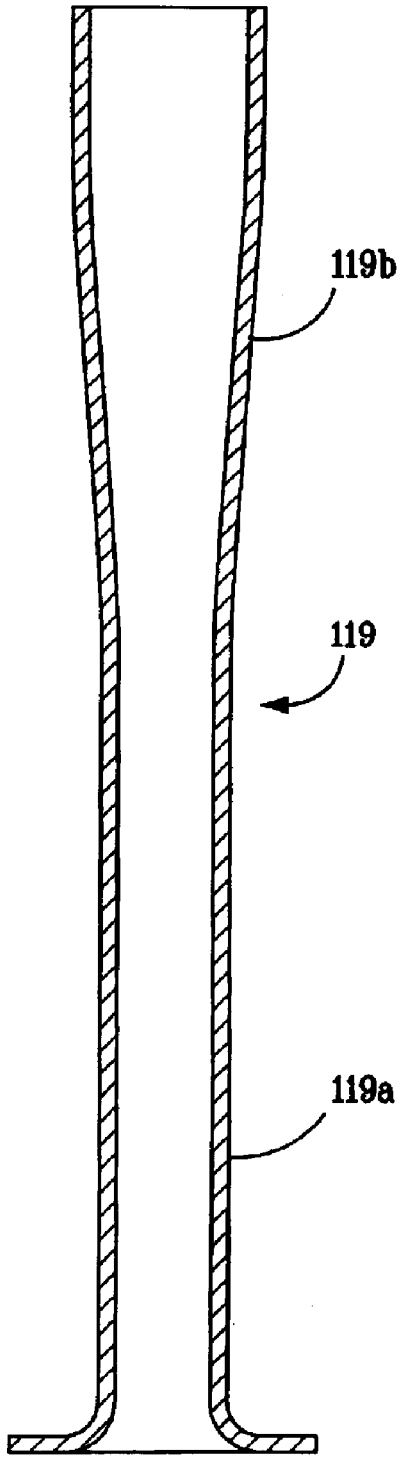

Referring now to FIG. 12A, a venturi 119 of a conventional flat-flame burner, includes a relatively short throat portion 119*a* that is of substantially constant internal cross-sectional dimensions along its length and a divergent cone portion 119*b*, wherein the ratio of the length to maximum internal cross-sectional dimension of the throat portion 19*a* is less than 3, typically 2.6. As shown in FIG. 12B, a venturi of a burner tube of a flat-flame burner in accordance with the present invention also includes a throat portion 119*a* of substantially constant internal cross-sectional dimensions and a divergent cone portion 119*b*. However, the throat portion 119*a* of the burner of the present invention is significantly longer than that of the conventional flat-flame burner, as shown in FIG. 12A such that the ratio of the length to maximum internal cross-sectional dimension of the throat portion 119*a* is at least 3, preferably from about 4 to about 10, more preferably from about 4.5 to about 8, still more preferably from about 6.5 to about 7.5 and most preferably from about 6.5 to about 7.0. The internal surface of the throat portion 119*a* of the burner of the present invention is preferably cylindrical.

Again, in addition to the use of flue gas as a diluent, another technique to achieve lower flame temperature through dilution is the use of steam injection. Steam can be injected in the primary air chamber 126 or the secondary air chamber 132. Preferably, steam is injected through steam injection tube 184, upstream of the venturi, for mixing with the primary air and recirculated flue gas to further reduce flame temperature and hence $NO_x$ emissions. The steam is conveniently provided through tube(s) terminating adjacent the gas spud 124, as shown.

It will also be understood that the teachings described herein also have utility in traditional raw gas burners and raw gas burners having a pre-mix burner configuration wherein flue gas alone is mixed with fuel gas at the entrance to the burner tube. In fact, it has been found that the pre-mix, staged-air burners of the type described in detail herein can be operated with the primary air damper doors closed, with very satisfactory results.

The invention will now be more particularly described with reference to the following Examples.

EXAMPLES 1–6

Table 1 below summarizes the geometry of a conventional premix burner with FGR (Example 1) and five premix burners (Examples 2–6) having modified venturi throat portions.

TABLE 1

| Example | Venturi Inlet Radius (in) | Venturi Throat Int. Dia. (in) | Venturi Throat Length (in) | Venturi Throat L/D | Venturi Cone Length (in) | Venturi Clone L/D | Venturi Cone Half Angle |
|---|---|---|---|---|---|---|---|
| 1 | 1.5 | 2.75 | 7.1 | 2.6 | 15.5 | 5.6 | 3.5 |
| 2 | 1.5 | 3.625 | 14.3 | 3.9 | 15.5 | 5.6 | 3.5 |
| 3 | 1.5 | 2.75 | 3.5 | 1.3 | 15.5 | 5.6 | 3.5 |
| 4 | 1.5 | 2.25 | 10.7 | 4.7 | 15.5 | 5.6 | 3.5 |
| 5 | 1.5 | 2.75 | 10.6 | 3.9 | 15.5 | 5.6 | 3.5 |
| 6 | 1.5 | 2.75 | 19.25 | 7 | 15.5 | 5.6 | 3.5 |

To assess the results of modifying the venturi throat portion, computational fluid dynamics, CFD, were used to evaluate the configurations summarized in Table 1. FLUENT™ software from Fluent Inc. was used to perform the analysis. (Fluent, Inc., USA, 10 Cavendish Court, Centerra Resource Park, Lebanon, N.H., 03766-1442). The fluid flows calculated for the various venturi designs are summarized in Table 2 below.

TABLE 2

| Example | Total mass flow (kg/sec) | Fuel Mass flow (kg/sec) | Air + FGR Mass Flow (kg/sec) | Change in Total Mass Flow versus Ex. 1 |
|---|---|---|---|---|
| 1 | 0.1827 | 0.0328 | 0.1499 | Base |
| 2 | 0.1685 | 0.0328 | 0.1357 | 92% |
| 3 | 0.1751 | 0.0328 | 0.1423 | 96% |
| 4 | 0.2064 | 0.0328 | 0.1736 | 119% |
| 5 | 0.1999 | 0.0328 | 0.1671 | 109% |
| 6 | 0.2292 | 0.0328 | 0.1964 | 125% |

As will be seen from Table 2, except for the burner of Example 2, increasing the length/diameter ratio of the venturi throat portion increased the total mass flow through the burner tube. For a given flow rate, in addition to an optimum L/D ratio, there is also an optimum diameter for the venturi. If the diameter is too small, it causes excessive frictional losses that limit the venturi capacity. If the diameter is too big (as in Example 2), flow separation occurs in the throat, which also reduces capacity.

Although increasing the length and hence the length/diameter ratio of the venturi throat portion increases the total mass flow through the burner tube, frictional losses overtake the advantage of increased flow if the throat portion becomes too long. Thus the length/diameter ratio of the venturi throat portion should preferably not exceed 10, more preferably is between about 6.5 and about 7.5 and most preferably is between about 6.5 and about 7.0.

Although illustrative embodiments have been shown and described, a wide range of modification change and substitution is contemplated in the foregoing disclosure and in some instances, some features of the embodiment may be employed without a corresponding use of other features. Accordingly, it is appropriate that the appended claims be construed broadly and in a manner consistent with the scope of the embodiments disclosed herein.

What is claimed is:

1. A pre-mix burner for the combustion of fuel in a furnace, said burner comprising:

(a) a burner tube having an upstream end, a downstream end and a venturi intermediate said upstream and downstream ends, said venturi including a throat portion having substantially constant internal cross-sectional dimensions such that the ratio of the length to maximum internal cross-sectional dimension of said throat portion is from about 6.5 to about 7.5;

(b) a burner tip mounted on the downstream end of said burner tube adjacent a first opening in the furnace, so that combustion of the fuel takes place downstream of said burner tip;

(c) a gas spud located adjacent the upstream end of said burner tube, for introducing fuel into said burner tube, said fuel flowing from said upstream end through said venturi to said downstream end; and (d) at least one passageway having a first end in fluid communication with a source flue gas and a second end adjacent the upstream end of the burner tube, flue gas being drawn from said furnace through said passageway in response to the inspirating effect of the fuel flowing though said venturi, wherein flue gas alone is mixed with fuel at the upstream end of said burner tube.

2. The burner according to claim 1, wherein said burner is a flat-flame burner.

3. The burner according to claim 1, further comprising at least one air port in fluid communication with a secondary air chamber of said furnace.

4. The burner according to claim 1, wherein the fuel is fuel gas.

5. The burner according to claim 1, wherein the ratio of the length to maximum internal cross-sectional dimension of said throat portion is from about 6.5 to about 7.0.

6. The burner according to claim 1, including one or more steam tubes terminating adjacent the upstream end of said burner tube for introducing steam into said burner tube along with flue gas and said fuel.

7. The burner according to claim 1 wherein said first end of said at least one passageway is located at a second opening in the furnace, said passageway being internal to the burner.

8. The burner according to claim 1 wherein said first end of said at least one passageway is in fluid communication with a furnace exhaust, said passageway being at least partially external to the furnace.

9. A method for combusting fuel in a pre-mix burner of a furnace, comprising the steps of combining fuel and flue gas at a predetermined location; passing the fuel and flue gas so combined through a venturi, drawing flue gas from the furnace in response to the inspirating effect of the fuel flowing though the venturi, and combusting said fuel at a combustion zone downstream of said predetermined location and said venturi, said venturi including a throat portion having substantially constant internal cross-sectional dimensions such that the ratio of the length to maximum internal cross-sectional dimension of said throat portion is from about 6.5 to about 7.5, wherein flue gas alone is mixed with fuel at the predetermined location.

10. The method according to claim 9, wherein the fuel is fuel gas.

11. The method according to claim 9, wherein said burner is a flat-flame burner.

12. The method according to claim 9, wherein said burner further comprises at least one air port in fluid communication with a secondary air chamber of said furnace.

13. The method according to claim 9, wherein the ratio of the length to maximum internal cross-sectional dimension of said throat portion is from about 6.5 to about 7.0.

14. The method according to claim 9 and further comprising the step of flowing steam through said venturi to mix with said flue gas upstream of said zone of combustion.

15. The method according to claim 14 wherein the furnace is a steam-cracking furnace.

16. The method according to 9 claim wherein the furnace is a steam-cracking furnace.

* * * * *